US007215286B2

(12) United States Patent
Chen

(10) Patent No.: US 7,215,286 B2
(45) Date of Patent: May 8, 2007

(54) NOTEBOOK AND ANTENNA THEREOF

(75) Inventor: Chih-Lung Chen, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 11 days.

(21) Appl. No.: 11/182,463

(22) Filed: Jul. 15, 2005

(65) Prior Publication Data

US 2006/0232482 A1 Oct. 19, 2006

(30) Foreign Application Priority Data

Apr. 15, 2005 (TW) ..... 94205921 U

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846, 848

See application file for complete search history.

(56) References Cited

U.S. PATENT DOCUMENTS 5,148,181 A * 9/1992 Yokoyama et al. ..... 343/702
5,861,854 A * 1/1999 Kawahata et al. ..... 343/702
5,943,019 A * 8/1999 Kawahata et al. ..... 343/702
6,008,762 A * 12/1999 Nghiem ..... 343/700 MS
6,147,652 A * 11/2000 Sekine ..... 343/702
6,943,738 B1 * 9/2005 Mattsson et al. .... 343/700 MS
2004/0178957 A1 * 9/2004 Chang et al. ..... 343/700 MS

* cited by examiner

*Primary Examiner*—Hoanganh Le
(74) *Attorney, Agent, or Firm*—Quintero Law Office

(57) ABSTRACT

An antenna comprises an antenna body, a cable, a substrate, a ground element and a conductive element. The antenna body, which is U-shaped, comprises a first portion, a second portion and a third portion. The first portion is planar, the second portion is connected to an end of the first portion, the third portion is connected to an end of the second portion, and the first portion is parallel to the third portion. The ground element and the conductive element are disposed on the substrate. An isolation gap is formed between the ground element and the conductive element. The first portion is coupled to the conductive element. The cable comprises a signal line coupled to the conductive element.

14 Claims, 8 Drawing Sheets

NOTEBOOK AND ANTENNA THEREOF

BACKGROUND

The invention relates to an antenna, and more particularly to an antenna for receiving a wireless digital television signal.

FIG. 1*a* shows a conventional flat antenna 1 utilized in a notebook, which comprises a signal receiving element 2, a signal line 3 and a ground element 4. The signal receiving element 2 is connected to the ground element 4. The signal line 3 is coupled to the signal receiving element 2. FIG. 1*b* shows signal reception of the conventional flat antenna 1, wherein when a wireless signal to be received comprises a center frequency of 575 MHz, a bandwidth thereof (bandwidth is defined as signals having voltage with standing wave ratios lower than 3) is between 40–50 MHz.

Improvement in digital television technology has lead to a demand for notebooks to receive wireless digital television signals. Thus, notebook antennas must have a wide bandwidth to receive television signals in different frequencies to provide different television channels. The frequencies of wireless digital television signals are between 400–800 MHz, and an antenna for receiving wireless digital television signals must have a bandwidth of at least 200 MHz. Thus, a convention flat antenna cannot be utilized for receiving wireless digital television signals.

SUMMARY

Antennas are provided. An exemplar embodiment of an antenna comprises: an antenna body; a cable; a substrate; a ground element and a conductive element. The antenna body, which is U-shaped, comprises a first portion, a second portion and a third portion, wherein the first portion is planar, the second portion is connected to an end of the first portion, the third portion is connected to an end of the second portion, and the first portion is parallel to the third portion. The ground element and the conductive element are disposed on the substrate. An isolation gap is formed between the ground element and the conductive element. The first portion is coupled to the conductive element. The cable comprises a signal line coupled to the conductive element.

The invention provides wider bandwidth enabling reception of wireless digital television signals.

BRIEF DESCRIPTION OF THE DRAWINGS

The invention will be more fully understood from the following detailed description and the accompanying drawings, given by the way of illustration only and thus not intended to limit the disclosure.

DETAILED DESCRIPTION

First Embodiment

Figure 1A:
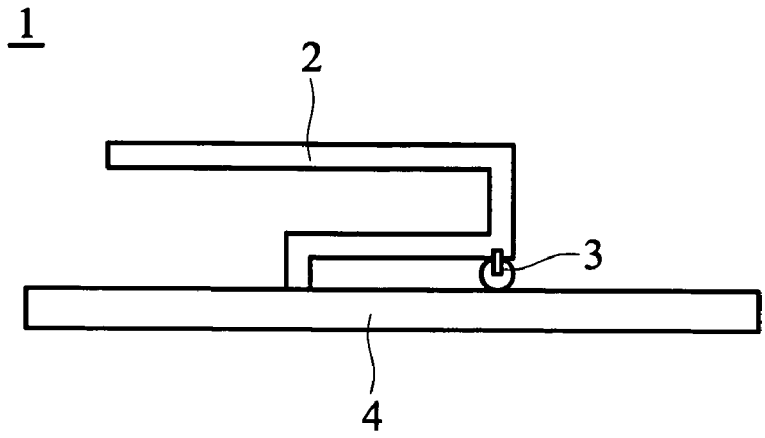
FIG. 1a (RELATED ART)
FIG. 1*a* shows a conventional flat antenna.
Figure 1B:
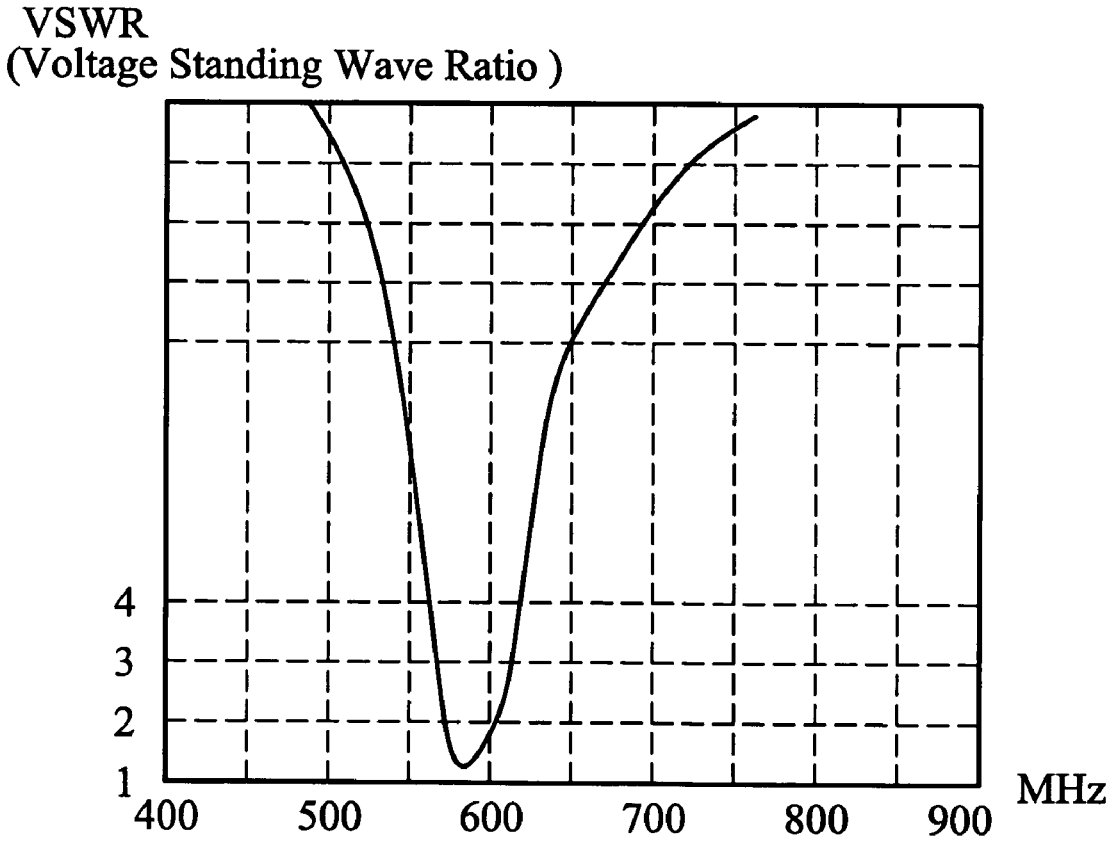
FIG. 1b (RELATED ART)
FIG. 1*b* shows signal reception of the conventional flat antenna.
Figure 2A:
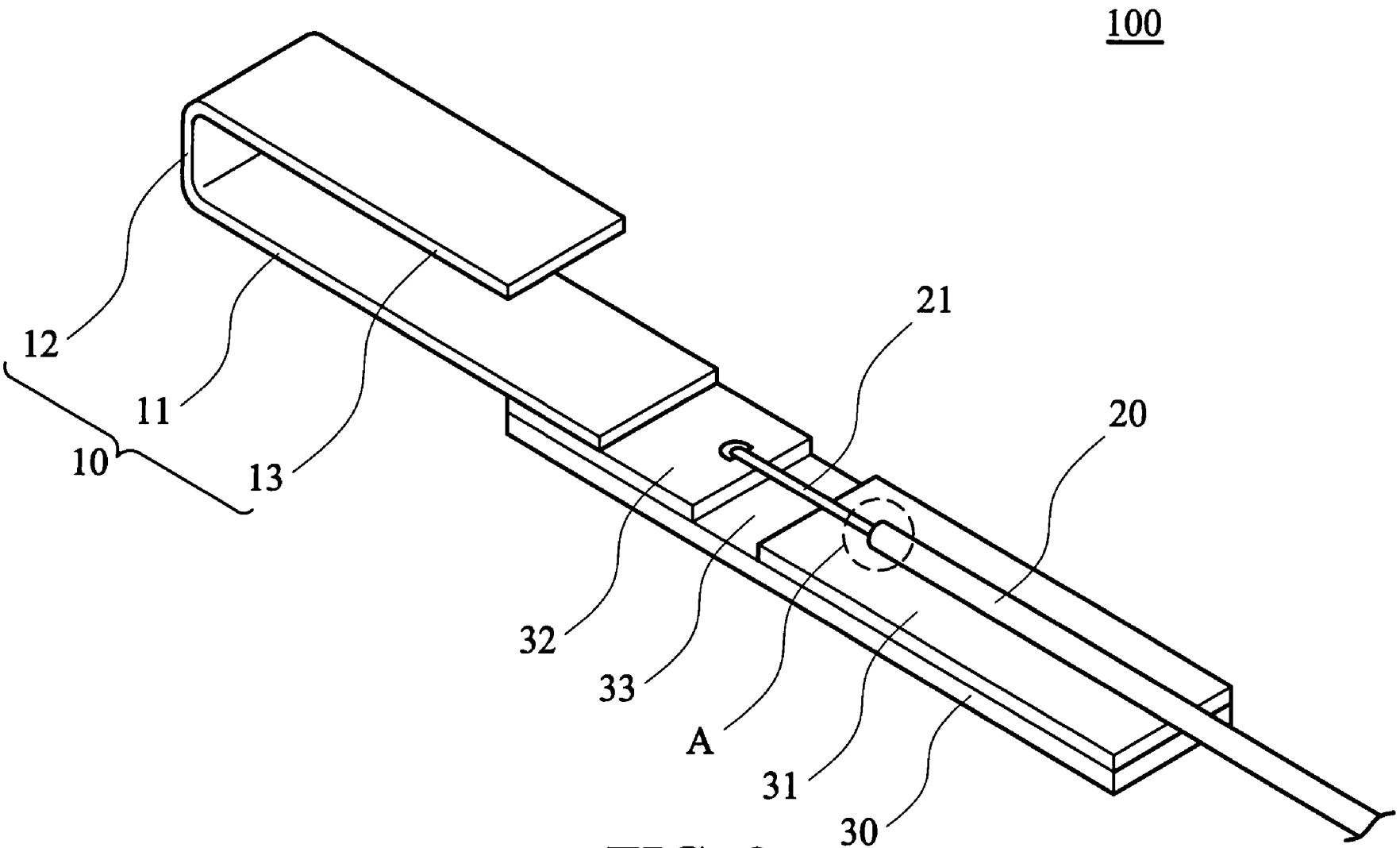
FIG. 2*a* shows an antenna of a first embodiment of the invention.

FIG. 2*a* shows an antenna 100 of a first embodiment of the invention, which comprises an antenna body 10, a cable 20, a substrate 30, a ground element 31 and a conductive element 32. The antenna body 10 is substantially U-shaped, and comprises a first portion 11, a second portion 12 and a third portion 13. The first portion 11, the second portion 12 and the third portion 13 are planar. The second portion 12 is connected to an end of the first portion 11. The third portion 13 is connected to an end of the second portion 12. The first portion 11 is parallel to the third portion 13. The ground element 31 is oblong. The ground element 31 and the conductive element 32 are disposed on the substrate 30. An isolation gap 33 is formed between the ground element 31 and the conductive element 32. The first portion 11 is coupled to the conductive element 32. The cable 20 comprises a signal line 21, and the signal line 21 is coupled to the conductive element 32.

In a modified example of the invention (not shown), the conductive element 32 is omitted, and the signal line 21 is directly coupled to another end of the first portion 11 opposite to the second portion 12.

Figure 2B:
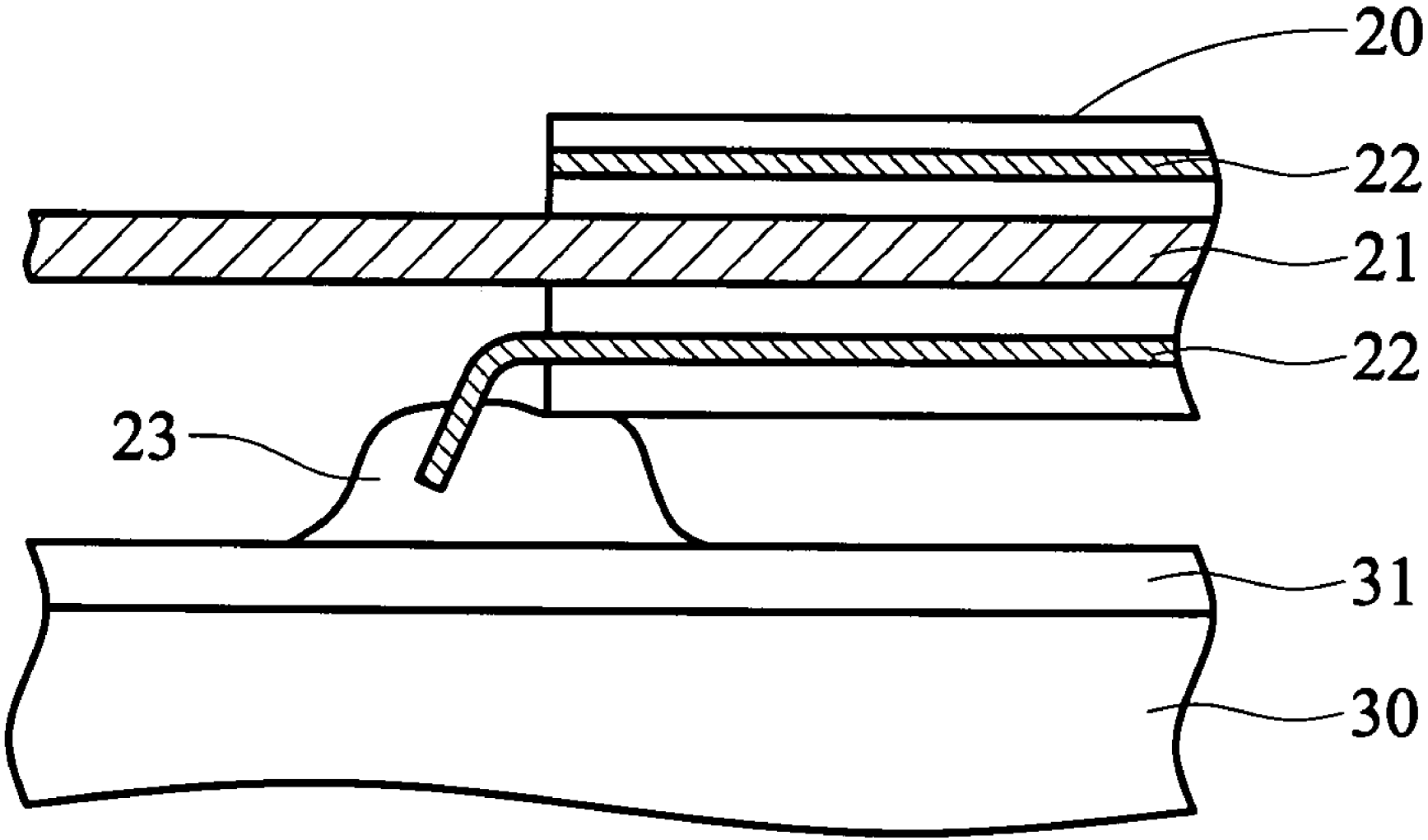
FIG. 2*b* is an enlarged view of portion A of FIG. 2*a;*

FIG. 2*b* is an enlarged view of portion A of FIG. 2*a*, wherein the cable 20 is a coaxial cable, and comprises the signal line 21 and a ground line 22. The ground line 22 is near the signal line 21. The ground line 22 is welded to the ground element 31 by solder 23.

Figure 2C:
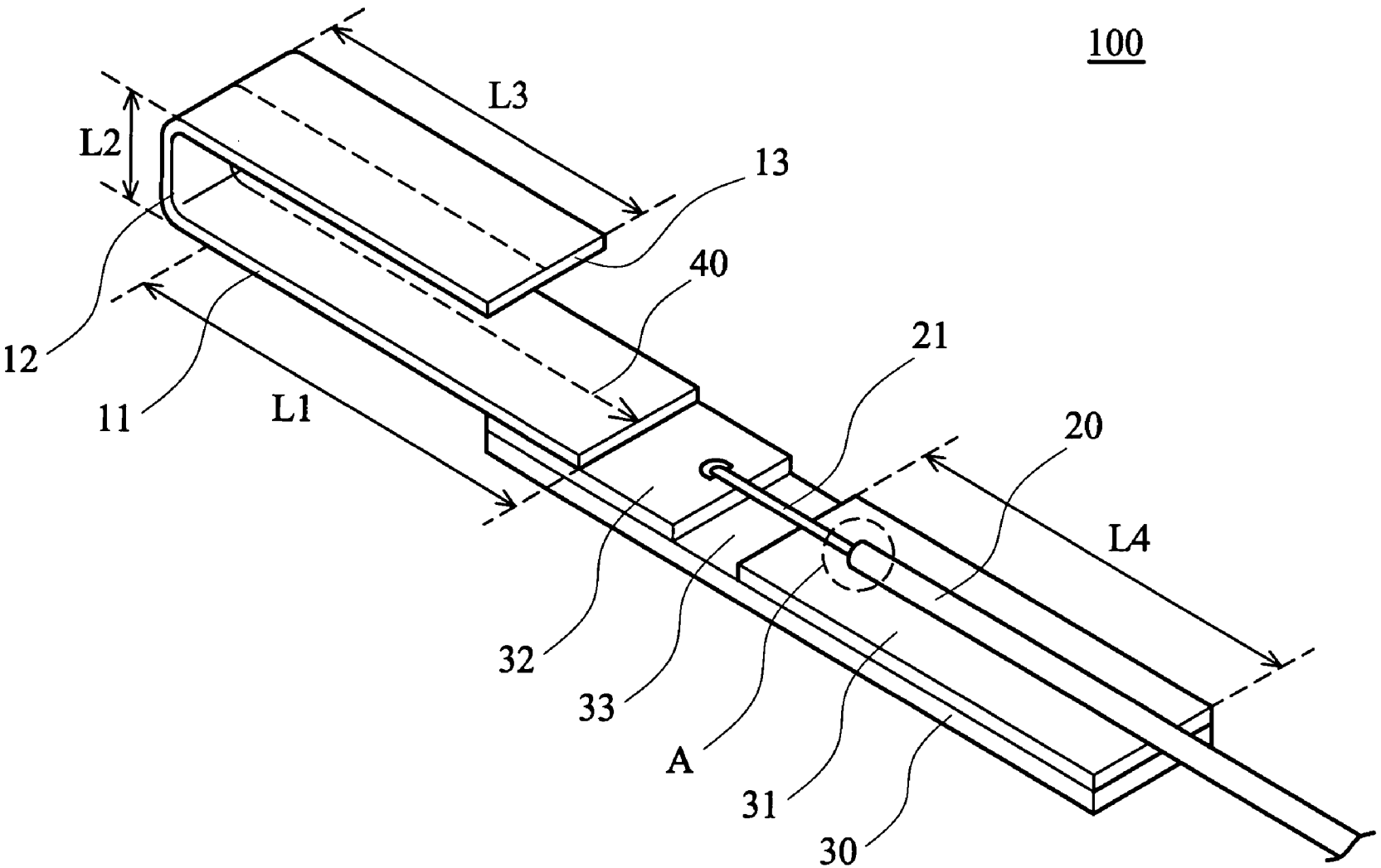
FIG. 2*c* shows a path of a wireless signal in the first embodiment of the invention.

With reference to FIG. 2*c*, when the antenna 100 receives a wireless signal 40, the wireless signal 40 passes through the third portion 13, the second portion 12 and the first portion 11 following a U-shaped path, and is transmitted to the conductive element 32 and the signal line 21. A length of the U-shaped path (the sum of a length L1 of the first portion 11, a length L2 of the second portion 12 and a length L3 of the third portion 13) is substantially equal to $\lambda/4$, wherein $\lambda$ is a wave length of the wireless signal 40. A length L4 of the ground element 31 is $\lambda/8$.

Figure 2D:
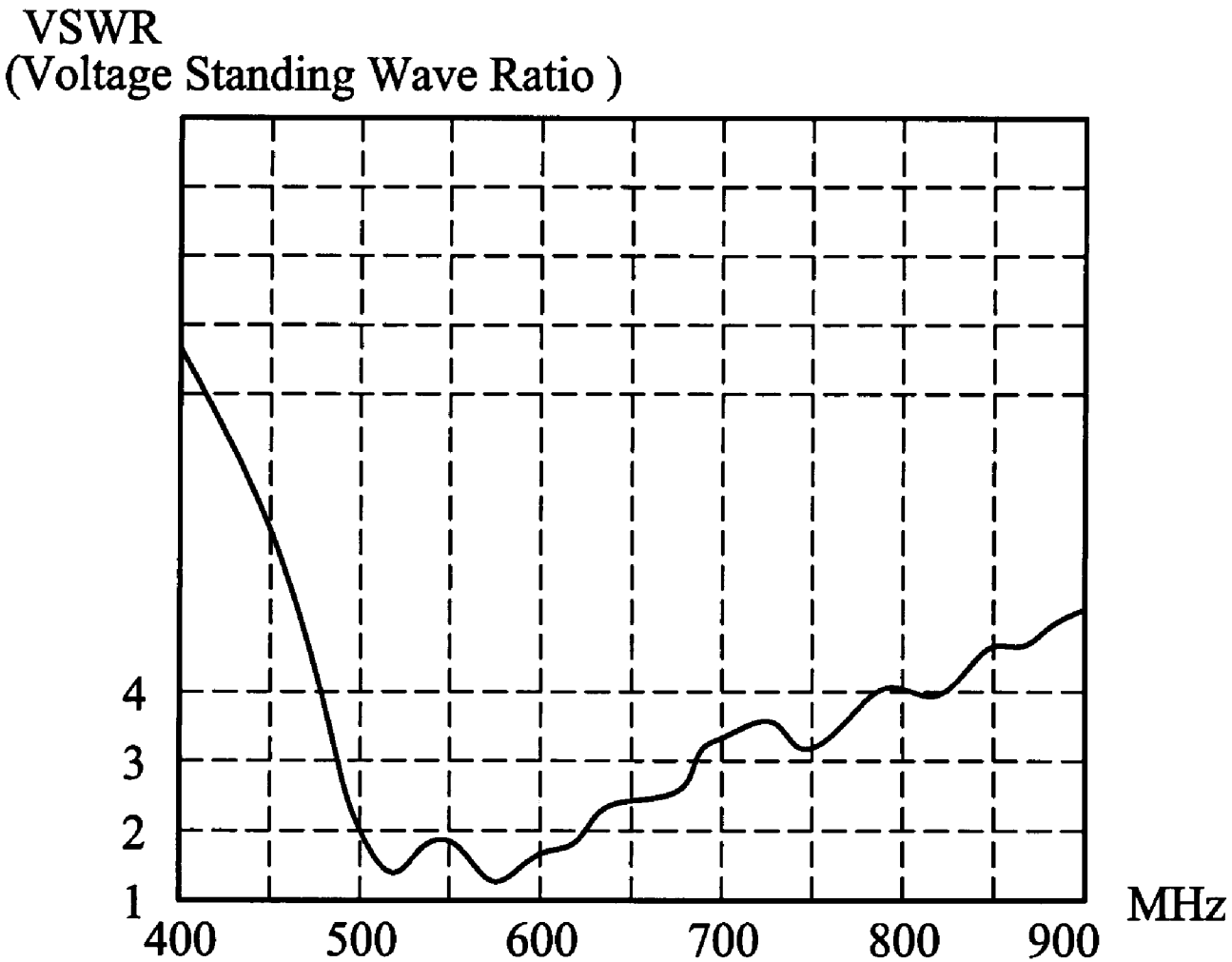
FIG. 2*d* shows signal reception of the antenna of the first embodiment of the invention.

FIG. 2*d* shows signal reception of the invention. When the antenna 100 receives the wireless signal comprising a center frequency 575 MHz, a bandwidth thereof (bandwidth is defined as signals having voltage with standing wave ratios lower than 3) is wider than 200 MHz. The invention thus provides wider bandwidth and enables reception of wireless digital television signals.

Figure 3:
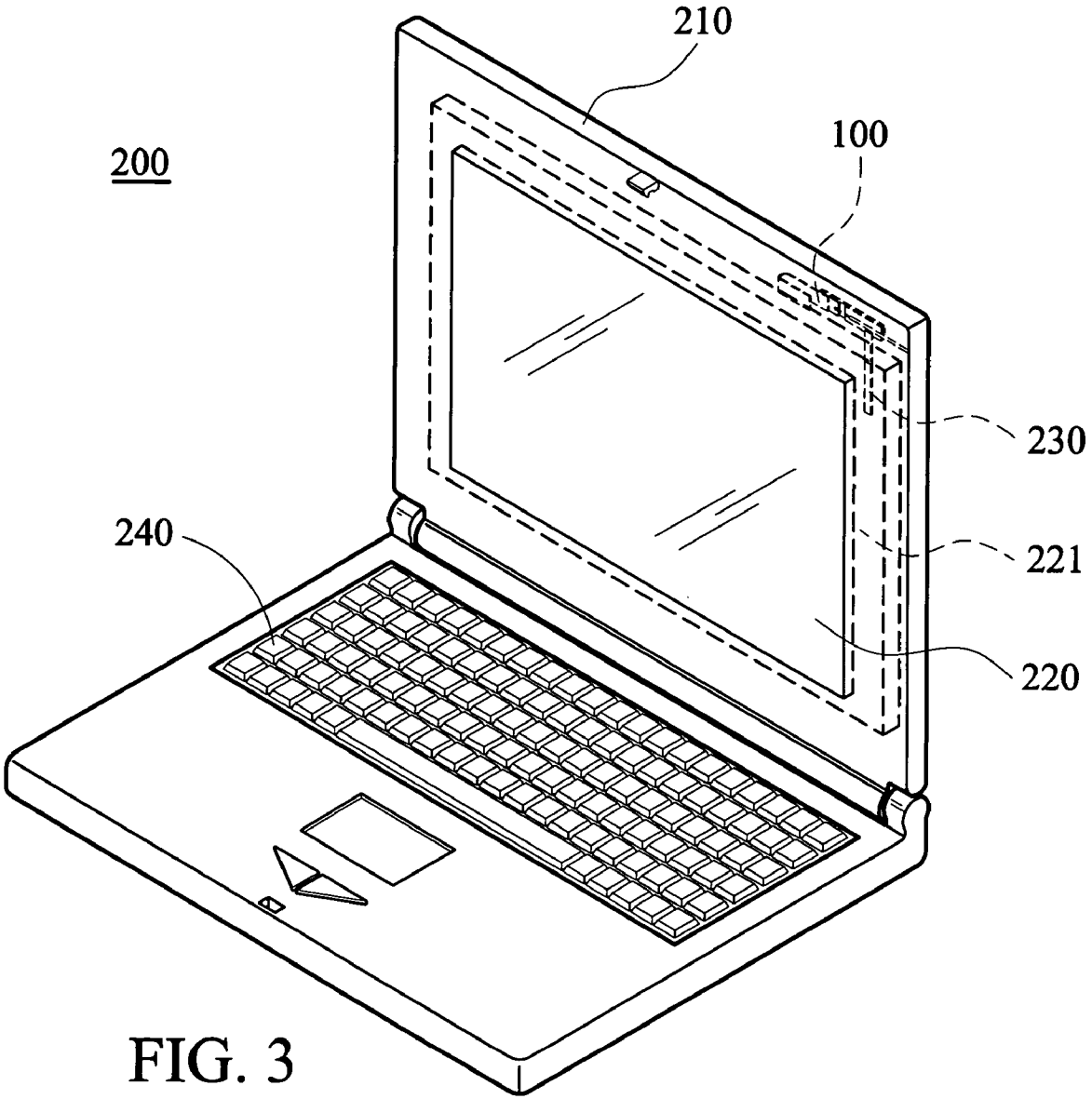
FIG. 3 shows a notebook utilizing the antenna of the invention.

FIG. 3 shows a notebook 200 utilizing the antenna 100 of the invention. The notebook 200 comprises a housing 210, a liquid crystal display 220, a back plate 221, a connection element 230, a control interface 240 and the antenna 100. The back plate 221, the connection element 230 and the antenna 100 are disposed in the housing 210. The back plate 221 is a metal plate and connected to the liquid crystal display 220. The connection element 230 is sheet metal and straddles a ground element of the antenna 100 and the back plate 221. A ground area of the antenna 100 is therefore increased, and bandwidth and impedance of the antenna 100 are more easily modified.

Second Embodiment

Figure 4A:
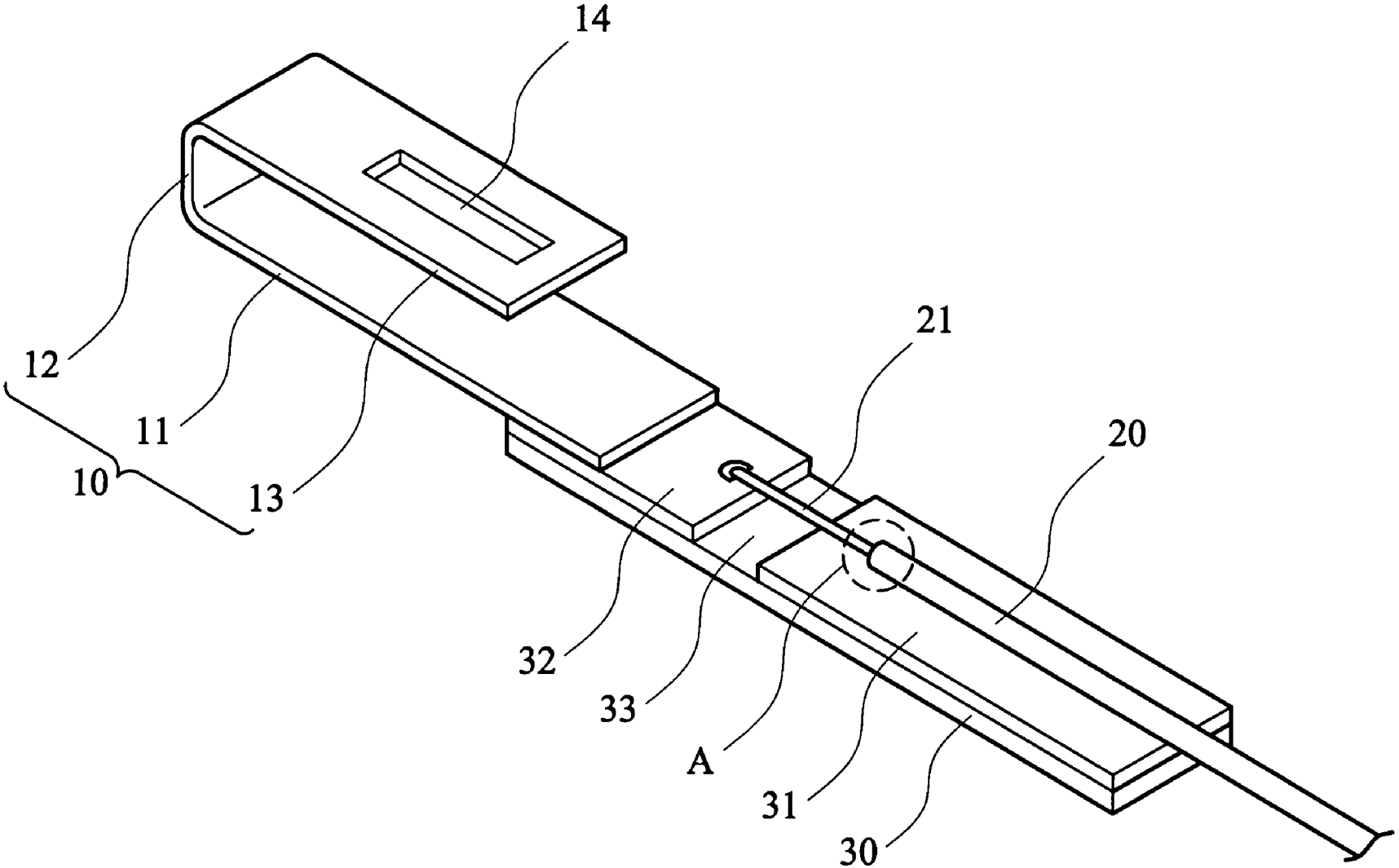
FIG. 4*a* shows an antenna of a second embodiment of the invention.

FIG. 4*a* shows a second embodiment of the invention, wherein an oblong opening 14 is formed on the third portion 13 of the antenna body 10. A resonance length of the antenna body 10 is therefore increased, and a size of the antenna 10 is reduced.

Third Embodiment

Figure 4B:
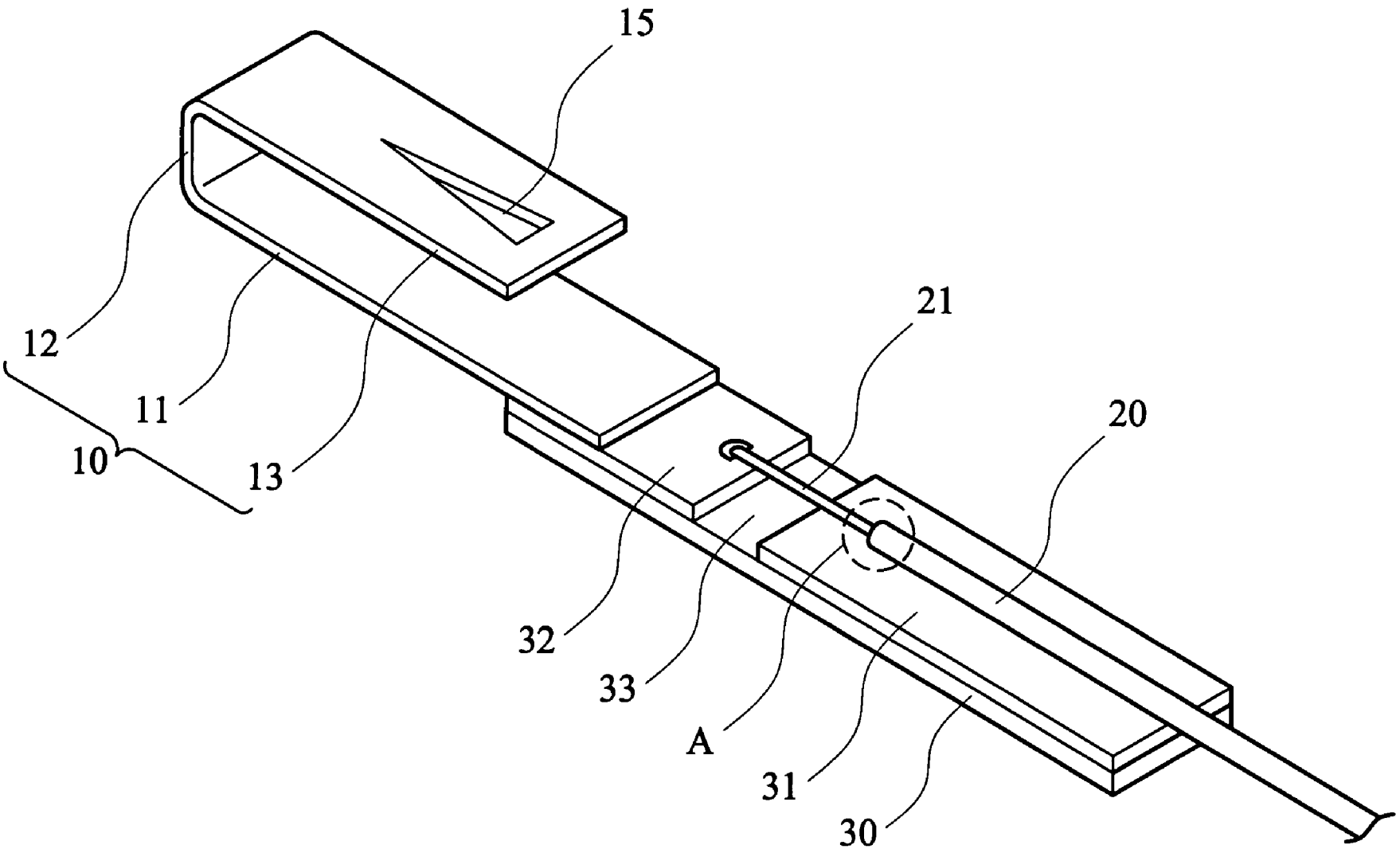
FIG. 4*b* shows an antenna of a third embodiment of the invention.

FIG. 4*b* shows a third embodiment of the invention, wherein a triangular opening 15 is formed on the third portion 13 of the antenna body 10. A resonance length of the antenna body 10 is therefore increased, and a size of the antenna 10 is reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna for receiving a wireless signal, comprising:
an antenna body, which is U-shaped, comprising a first portion, a second portion and a third portion, wherein the first portion is planar and located on a base plane, the second portion is connected to an end of the first portion and extends in a direction perpendicular to the base plane, the third portion is connected to an end of the second portion, and the first portion is parallel to the third portion;
a signal line, coupled to the first portion, wherein the signal line is coupled to another end of the first portion opposite to the second portion;
a ground line, next to the signal line;
a ground element, coupled to the ground line;
a substrate, wherein the ground element is disposed on the substrate; and
a conductive element, straddling the antenna body and the signal line, wherein the conductive element is disposed on the substrate.

2. The antenna as claimed in claim 1, wherein an isolation gap is formed between the conductive element and the ground element.

3. The antenna as claimed in claim 1, wherein the ground element is oblong, a length of the ground element is substantially equal to $\lambda/8$, and $\lambda$ is a wave length of the wireless signal.

4. The antenna as claimed in claim 1, wherein when the antenna receives the wireless signal, the wireless signal passes through the third portion, the second portion and the first portion following a U-shaped path, and is transmitted to the signal line, wherein the third portion comprises an opening.

5. The antenna as claimed in claim 4, wherein a length of the U-shaped path is substantially equal to $\lambda/4$, and $\lambda$ is a wave length of the wireless signal.

6. The antenna as claimed in claim 1, wherein the third portion is planar.

7. A notebook for receiving a wireless signal, comprising:
a display;
a back plate, connected to the display;
an antenna body, which is U-shaped, comprising a first portion , a second portion and a third portion, wherein the first portion is planar and located on a base plane, the second portion is connected to an end of the first portion and extends in a direction perpendicular to the base plane, the third portion is connected to an end of the second portion, and the first portion is parallel to the third portion;
a signal line, coupled to the first portion;
a ground line, next to the signal line;
a ground element, coupled to the ground line; and
a connection element, straddling the ground element and the back plate.

8. The notebook as claimed in claim 7, wherein the ground element is oblong, a length of the ground element is substantially equal to $\lambda/8$, and $\lambda$ is a wave length of the wireless signal.

9. The notebook as claimed in claim 7, further comprising a substrate, wherein the ground element is disposed on the substrate.

10. The notebook as claimed in claim 7, further comprising a conductive element, straddling the antenna body and the signal line, wherein the conductive element is disposed on the substrate.

11. The notebook as claimed in claim 10, wherein an isolation gap is formed between the conductive element and the ground element.

12. The notebook as claimed in claim 7, wherein the signal line is coupled to another end of the first portion opposite to the second portion.

13. The notebook as claimed in claim 7, wherein when the antenna receives the wireless signal, the wireless signal passes through the third portion, the second portion and the first portion following a U-shaped path, and is transmitted to the signal line, wherein the third portion comprises an opening.

14. The notebook as claimed in claim 7, wherein a length of the U-shaped path is substantially equal to $\lambda/4$, and $\lambda$ is a wave length of the wireless signal.

* * * * *